United States Patent [19]

Tasaki et al.

[11] Patent Number: 4,898,095

[45] Date of Patent: Feb. 6, 1990

[54] LASER BEAM-DETONATABLE BLASTING CAP

[75] Inventors: Yoji Tasaki; Koichi Kurokawa; Katsuhide Hattori, all of Aichi; Mikio Takano, Tokyo; Toshikazu Miyajima, Yamato; Toshifumi Sato, Sagamihara; Katsura Ogasawara, Kodaira, all of Japan

[73] Assignees: Nippon Oil and Fats Company, Limited and Kajima Corporation; Kajima Corporation, both of Japan

[21] Appl. No.: 180,882

[22] Filed: Apr. 13, 1988

[30] Foreign Application Priority Data

| | | | |
|---|---|---|---|
| Oct. 20, 1986 | [JP] | Japan | 61-247597 |
| Apr. 30, 1987 | [JP] | Japan | 62-106745 |
| Apr. 30, 1987 | [JP] | Japan | 62-106744 |

[51] Int. Cl.[4] ..... F42B 3/10

[52] U.S. Cl. ..... 102/201

[58] Field of Search ..... 102/201

[56] References Cited

U.S. PATENT DOCUMENTS

| | | | |
|---|---|---|---|
| 3,258,910 | 7/1966 | Seymour | 102/201 |
| 3,528,372 | 9/1970 | Lewis et al. | 102/201 |
| 3,620,166 | 11/1971 | Bratton et al. | 102/201 |
| 3,724,383 | 4/1973 | Gallaghan et al. | 102/201 |
| 3,791,302 | 2/1974 | McLeod | 102/201 |
| 3,877,373 | 4/1975 | Bergmann et al. | 102/201 |
| 4,391,195 | 7/1983 | Shann | 102/201 |

*Primary Examiner*—Charles T. Jordan

*Attorney, Agent, or Firm*—Arnold, White & Durkee

[57] ABSTRACT

A laser beam-detonatable blasting cap containing secondary explosives charged therein in the upper and lower portions, wherein the explosive charged in the upper portion contains a laser beam-absorbing black material and is contacted with an optical fiber at the top. The loading density of the explosive charged in the lower portion is higher than that of the explosive charged in the higher portion, and only the side of the explosive charged in the upper portion is surrounded with a restraining wall. The blasting cap can be easily and surely detonated by a laser beam having a low peak output power generated by means of a pulse-oscillation system without using Q-switching or a continous oscillation system.

9 Claims, 2 Drawing Sheets

LASER BEAM-DETONATABLE BLASTING CAP

BACKGROUND OF THE INVENTION (1) Field of the Invention

The present invention relates to a laser beam-detonatable blasting cap having improved detonatability, wherein a specifically limited explosive is used. The structure of the chamber to be charged with the explosive, the loading density of the explosive and the restraining condition for the chamber are also specifically limited.

(2) Related Art Statement

There have hitherto been used a blasting cap detonated by a safety fuse, and an electric detonator detonated by an electric current supplied through a lead wire. In addition, there has recently been developed a laser beam-detonatable blasting cap detonated by means of a laser beam.

As the laser-oscillating apparatus for such a laser beam-detonatable blasting cap, there are used a ruby laser, a YAG (yttrium.aluminum.garnet) laser and the like.

As a conventional blasting cap detonated by a laser beam generated by means of the above described laser-oscillating apparatus, there is known a blasting cap illustrated in FIG. 5 in the accompanying drawings in this specification (for further reference, see U.S. Pat. No. 3,528,372). This laser beam-detonatable blasting cap 40 comprises a vacant space 49, a first chamber 41 defined by a plate 48, and a second chamber 42, wherein an optical fiber 43 is connected through a lens 45 to the top of the explosive 46 arranged in the first chamber 41. Both the chambers 41 and 42, the plate 48, the vacant space 49, the lens 45 and the optical fiber 43 are surrounded with a restraining wall 47. The end of the optical fiber 45 is tightly closed by means of a plug 44. The explosives 46 and 50 charged into the first chamber 41 and second chamber 42, respectively, in the form of a multi-layered structure are secondary explosives. The loading density of an explosive charged in the upper portion is higher than that of an explosive charged in the lower portion in each chamber, and both the chambers are the same in the average loading density of the explosives charged therein. In FIG. 5, the numeral 51 represents a bottom plate of the blasting cap 40.

The above described laser beam-detonatable blasting cap has the following drawbacks. A secondary explosive is charged alone in the first chamber at the portion contacting the optical fiber, and therefore, a laser beam irradiated to the explosive through the optical fiber is substantially wholly reflected, and hence the laser beam is not able to be effectively absorbed in the explosive. The loading density of an explosive charged in the upper portion is higher than that of an explosive charged in the lower portion in each chamber, and therefore, the explosives charged in the first chamber are low in ignition sensitivity by the laser beam. Moreover, the restraining wall is arranged so as to surround not only the first chamber, but also the second chamber. Therefore, when the explosives in the second chamber are detonated, the power of the explosives in the second chamber is concentrated to the bottom of the second chamber, and thus, the explosives cannot effectively ignite an explosive which has been charged in the cartridge case at the portion contacting with the restraining wall.

SUMMARY OF THE INVENTION

The object of the present invention is to eliminate the above described drawbacks and to provide a laser beam-detonatable blasting cap having a specifically limited structure, which cap can absorb the laser beam effectively, and can be ignited easily and detonated safely. Hence, complete ignition of an explosive charged in a cartridge case can readily be achieved.

A first aspect of the present invention lies in a laser beam-detonatable blasting cap, wherein an optical fiber is contacted with the upper portion of an explosive and a restraining wall is arranged on the side of the explosive. The improvement comprises an explosive charged in the upper portion of the blasting cap, at which the explosive is contacted with the optical fiber, which is a secondary explosive containing a laser beam-absorbing black material. The loading density of the explosive charged in the lower portion of the blasting cap is higher than that of the explosive charged in the upper portion, and only the side of the explosive charged in the upper portion is surrounded with the restraining wall.

A second aspect of the present invention lies in a laser beam-detonatable blasting cap, wherein a first chamber and a second chamber are arranged separated from each other by a vacant space, and an optical fiber is contacted with the top of an explosive charged in the first chamber. The outer sides of the first and second chambers are surrounded with a restraining wall, and the loading density of an explosive charged in the lower portion of the blasting cap is higher than that of an explosive charged in the upper portion in each chamber. The improvement comprises the explosive charged in the first chamber is a secondary explosive containing a laser beam-absorbing black material, the loading density of the explosive charged in the second chamber is higher than that of the explosive charged in the first chamber, and only the outer side of the first chamber is surrounded with a restraining wall.

DESCRIPTION OF THE PREFERRED EMBODIMENT

The present invention will be explained hereinafter referring to the accompanying drawings.

Figure 1:
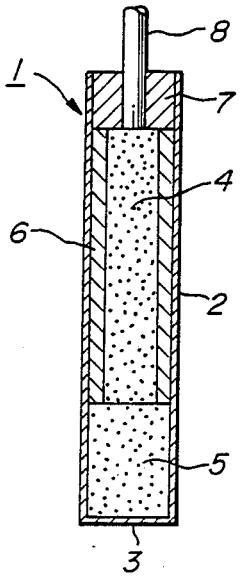
FIG. 1 is a cross-sectional view of one embodiment of the laser beam-detonatable blasting cap according to the first aspect of the present invention.

FIG. 1 illustrates one embodiment of the laser beam-detonatable blasting cap according to the first aspect of the present invention. Referring to FIG. 1, a laser beam-detonatable blasting cap 1 comprises a shell 2 having a bottom plate 3. A secondary explosive 4 is charged into the upper portion of the shell 2 and contains a laser beam-absorbing material, and a secondary explosive 5 is charged into the lower portion of the shell 2. In this case, a restraining wall 6 is arranged inside the shell 2 so as to surround the side of the secondary explosive 4 charged in the upper portion of the shell 2. A plug 7 having an optical fiber 8 penetrating through its center portion is arranged on the upper side of the explosive 4 so as to cover the explosive 4. That is, the plug 7 is fitted into the upper end portion of the shell 2 while maintaining the state, wherein an optical fiber 8 is penetrated through the center portion of the plug 7, whereby the opening at the end of the optical fiber 8 is directly contacted with the explosive 4.

As the explosive to be used in the laser beam-detonatable blasting cap according to the present invention, there can be used secondary explosives, such as PETN (pentaerythritol tetranitrate), tetryl (trinitrophenylmethylnitramine), RDX (trimethylenetrinitramine), HMX (cyclotetramethylene-tetranitramine) and the like. Particularly, in the explosive 4 to be charged in upper portion of the blasting cap, there is used, as an ignition charge or initiating explosive, a secondary explosive containing 0.5–10% by weight of a laser beam-absorbing material, such as carbonaceous black material, for example carbon black, graphite or the like, or a dyestuff having an absorption band in the wavelength of the laser beam, for example black dyestuff (for example, Direct Fast Black B, sold by Sumitomo Chemical Co.) or the like, in order to efficiently absorb the laser beam.

In the present invention, the secondary explosive, for example, when PETN is used, is charged into the laser beam-detonatable blasting cap in a loading density within the range of 0.8–1.7 g/cm$^3$. In this case, the loading density of the explosive 4 charged into the upper portion should be generally within the range of 0.8–1.4 g/cm$^3$, and preferably within the range of 0.8–1.2 g/cm$^3$. The loading density of the explosive 5 charged into the lower portion should be generally within the range of 1–1.7 g/cm$^3$, and preferably within the range of 1.2–1.7 g/cm$^3$. That is, it is necessary that the loading density of the explosive 4 charged in the upper portion should be low in order that the explosive 4 has a high ignition sensitivity by the laser beam, can easily continue its combustion after ignition, can be easily changed from combustion to deflagration and can be easily changed from deflagration to detonation. Further, it is necessary that the loading density of the explosive 5 charged in the lower portion should be high in order that the explosive 5 can be completely detonated by the detonation wave of the explosive 4 charged in the upper portion. It is also necessary that the explosive 5 exhibits a high explosion power enough to completely ignite an explosive, in which the laser beam-detonatable blasting cap according to the present invention has been set.

The restraining wall 6 is made of metal, such as iron, stainless steel, aluminum and the like, having a high tensile strength, or is made of reinforced plastics having the same tensile strength as that of these metals. The thickness of the restraining wall 6 is determined depending upon the inner diameter of the upper chamber and the kind of the material to be used in the restraining wall. When the chamber has an inner diameter of 6 mm, and the restraining wall is made of iron, the use of a restraining wall having a thickness of at least 0.1 mm can attain the object of the present invention, but a restraining wall having a thickness of 1–2 mm is generally used. The restraining wall 6 is used in order to maintain the gas pressure generated by the ignition and combustion of an explosive 4 charged in the upper portion. Accordingly, the length of the restraining wall 6 must be such that the wall 6 covers at least the side of the explosive 4 charged in the upper portion. Further, not only the side of the explosive 4 charged in the upper portion, but also the side of an explosive 5 charged in the lower portion may be covered with the restraining wall 6. However, in this case, the explosive 5 charged in the lower portion is poor in the ability for initiating an explosive charged in a cartridge case at the portion contacted with the side of the explosive 5 as compared with the case, wherein the restraining wall 6 does not cover the side of the explosive 5.

The shell 2 is used as a vessel for receiving explosives 4 and 5 charged therein, and the material and the thickness of the shell 2 can be freely selected insofar as that the shell is not deformed by the pressure generated during the charging of the explosives. As the material of the shell 2, there can be used iron, copper, aluminum, reinforced plastic material and the like. For example, when a shell 2 is made of copper, and when it is intended to charge explosives into the shell in a loading density of 1.4, the use of a shell having a thickness of about 0.1 mm can attain the object of the present invention. The optical fiber 8 may be directly contacted with the secondary explosive 4 containing a laser beam-absorbing material or may be indirectly contacted with the explosive 4 containing the laser beam-absorbing material through a lens.

Another embodiment of the laser beam-detonatable blasting cap according to the first aspect of the present invention will be explained hereinafter referring to FIG. 2.

In this embodiment, a laser beam-detonatable blasting cap 10 comprises a shell 11 having a bottom plate 12. A secondary explosive 4 containing a laser beam-absorbing material is charged into the upper portion of the shell 11 in a length, generally, within the range of 1–15 mm, which is large enough to cause a complete ignition of the explosive 4 by the absorption of a laser beam. Secondary explosives 13 and 5 are charged in the middle portion and lower portion of the shell 11, respectively. The upper side of the shell 11 is covered with a plug 7 having an optical fiber 8 penetrating through its center portion. That is, the plug 7 is fitted into the upper end portion of the shell 11 while maintaining the penetrated state of the optical fiber 8, whereby the opening at the end of the optical fiber 8 is directly contacted with the explosive 4. Further, the outer side of the shell 11 is surrounded with a restraining wall 6 at the portion surrounding the explosives 4 and 13 arranged in the upper and middle portions, respectively.

In the above described blasting cap of the present invention illustrated in FIG. 1, when light is irradiated through the optical fiber to the top of an explosive charged in the laser beam-detonatable blasting cap, a laser beam-absorbing material contained in the explosive charged in the upper portion of the blasting cap is heated to ignite the explosive surrounding the laser beam-absorbing material, and hence the combustion speed of the explosive charged in the upper portion and surrounded with a restraining wall is increased and the gas pressure is increased. Accordingly, when the combustion proceeds to an explosive charged in the lower portion, the pressure of the combustion gas is increased to a high pressure enough to detonate the explosive charged in the lower portion, and the explosive charged in the lower portion is detonated to initiate an explosive, which has been charged in a cartridge case, and in which the laser beam-detonatable blasting cap of the present invention has been set.

Figure 2:
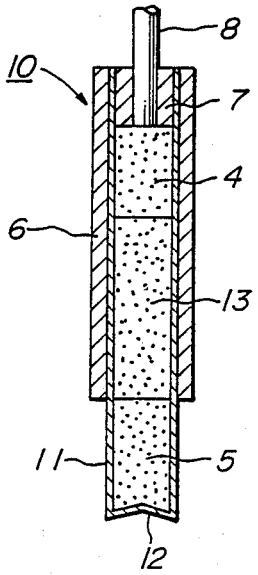
FIG. 2 is a cross-sectional view of another embodiment of the laser beam-detonatable blasting cap according to the first aspect of the present invention.

The laser beam-detonatable blasting cap of the present invention illustrated in FIG. 2 acts in the same manner as described in the blasting cap illustrated in FIG. 1, except that the explosion proceeds from the explosive in the upper portion through the explosive in the middle portion to the explosive in the lower portion.

Figure 3:
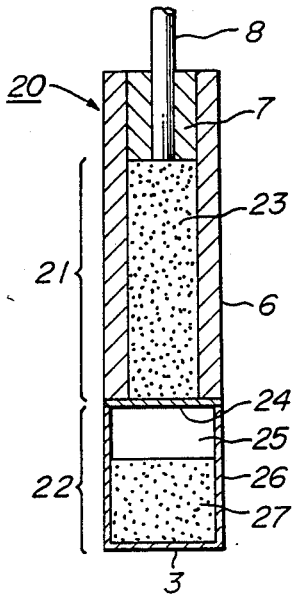
FIG. 3 is a cross-sectional view of one embodiment of the laser beam-detonatable blasting cap according to the second aspect of the present invention.
Figure 4:
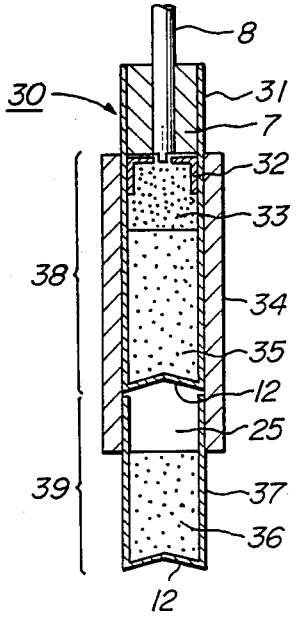
FIG. 4 is a cross-sectional view of another embodiment of the laser beam-detonatable blasting cap according to the second aspect of the present invention.

FIGS. 3 and 4 are cross-sectional views illustrating the laser beam-detonatable blasting caps according to the second aspect of the present invention, wherein a vacant space is formed between a first chamber and a second chamber, both containing a secondary explosive charged therein.

One embodiment of the laser beam-detonatable blasting cap according to the second aspect of the present invention will be explained referring to FIG. 3. In this embodiment, a laser beam-detonatable blasting cap 20 comprises a first chamber 21, a second chamber 22 adjacent to the first chamber 21, and an optical fiber 8 arranged in the first chamber 21 at the side opposite to the second chamber 22. The first chamber 21 is defined by a restraining wall 6, a plug 7 and a plate 24, and the second chamber 22 is defined by a shell 26 and a bottom plate 3. A secondary explosive 23 containing a laser beam-absorbing material is charged into the first chamber 21, and the opening at the end of the above described optical fiber 8 is directly contacted with the explosive 23 at its top. Further, the explosive 23 and the end of the optical fiber 8 are surrounded with a restraining wall 6 in the following manner. One end of the optical fiber 8 is fitted into the plug 7, and the plug 7 is fitted into one end of the restraining wall 6 so as to seal the explosive 23 in the first chamber 21. Further, the first chamber 21, and hence the restraining wall 6, is covered with the plate 24 at the end opposite to the plug 7 so as to seal the explosive 23 in the first chamber 21. The second chamber 22 defined by a shell 26 having a bottom plate 3 is arranged adjacent to the plate 24 forming the first chamber 21. A secondary explosive 27 is charged into the shell 26 in an amount that a vacant space 25 is formed in the upper portion of the shell 26. The outer diameter of the shell 26 is made substantially the same as the outer diameter of the restraining wall 6.

The kinds of the secondary explosive and the laser beam-absorbing material, and the addition amount of the laser beam-absorbing material to the secondary explosive are the same as those in the above described first aspect of the present invention.

The loading density of the explosive, for example when PETN is used, charged in the first chamber 21 and second chamber 22 should be generally within the range of 0.8–1.7 g/cm$^3$. In this case, the loading density of the explosive 23 charged in the first chamber 21 should be generally selected from the range of 0.8–1.4 g/cm$^3$ and preferably selected from the range of 0.8–1.2 g/cm$^3$. Because, it is necessary that an explosive 23 charged in the first chamber 21 has a high ignition sensitivity by the laser beam, and can continue combustion after ignition, and can be easily changed from combustion into deflagration, and further can project the plate 24 of the first chamber 21 by the gas pressure generated in the first chamber 21 to the second chamber 22 at a speed high enough to detonate the explosive 27 charged as a based charge in the second chamber 22 by the collision of the plate 24 with the explosive 27. The loading density of the explosive 27 charged in the second chamber 22 is selected generally from the range of 1–1.7 g/cm$^3$, and preferably from the range of 1.2–1.7 g/cm$^3$, because it is necessary that the explosive 27 charged in the second chamber 22 is completely detonated by its collision with the plate 24 flown from the first chamber 21 and has a power high enough to initiate completely an explosive, in which the laser beam-detonatable blasting cap according to the present invention has been set. As described above, it is advantageous that the loading density of the explosive charged in the second chamber 22 is higher than that of the explosive charged in the first chamber 21.

The restraining wall 6 is arranged, so that when the explosive 23 charged in the first chamber 21 illustrated in FIG. 3 is ignited and combusted, the pressure of the combustion gas is maintained. The length of the restraining wall 6 should be such that the restraining wall covers the side of the explosive 23 charged in the first chamber 21 illustrated in FIG. 3, and should be at least the same length as the length of the explosive 23 charged in the first chamber 21. This restraining wall 6 may be extended so as to cover the side of the vacant space 25. The restraining wall 6 may be further extended so as to cover the side of the second chamber 22. However, in this case, the explosive 27 charged in the second chamber 22 is somewhat poor in the power for initiating an explosive charged in a cartridge case at the portion contacting with the surface of the outer side of the second chamber 22, as compared with case wherein the side of the second chamber 22 is not covered.

The material, thickness and the like of the restraining wall 6 are the same as those in the first aspect of the present invention.

The plate 24 for the first chamber 21 illustrated in FIG. 3 is used in order to maintain the explosive 23 in the first chamber 21, and further to be flown to the second chamber 22 by the gas pressure generated by the combustion of the explosive 23, and to collide with the explosive 27 contained in the second chamber 22, causing the detonation of the explosive 27. Therefore, any plates which can be easily flown by the gas pressure generated in the first chamber 21, can be used as the plate 24, and the plate 24 is generally made of a metal of iron, copper, aluminum or the like, and has a thickness within the range of 0.1–1 mm.

The material, thickness and the like of the shell 26 can be determined in the same manner as described in the first aspect of the present invention.

The optical fiber 8 may be directly contacted with the secondary explosive 23 containing a laser beam-absorbing material or may be indirectly contacted with the explosive 23 through a lens in the same manner as described in the first aspect of the present invention.

Another embodiment of the laser beam-detonatable blasting cap according to the second aspect of the present invention will be explained referring to FIG. 4. In this embodiment, a laser beam-detonatable blasting cap 30 comprises a first chamber 38, and a second chamber 39 adjacent thereto, and an optical fiber 8 arranged in the first chamber 38 at the side opposite to the second chamber 39. The first chamber 38 is defined by a shell 31 having a bottom plate 12, an inner tube 32 and a plug 7, and the second chamber 39 is defined by a shell 37 having a bottom plate 12, and the bottom plate 12 of the upper shell 31. A secondary explosive 35 is charged into the lower portion of the first chamber 38, and a secondary explosive 33 containing a laser beam-absorbing material is charged in the upper portion of the first chamber 38 in a length generally within the range of 1–15 mm. The explosive 33 is covered with an inner tube 32 having a hole, and a plug 7 is arranged on the inner tube 32. In this case, the optical fiber 8 is penetrated through the center portion of the plug 7 such that the opening at the end of the optical fiber 8 can be entered into the hole of the above described inner tube 32. Therefore, when the plug 7 is fitted into the upper end portion of the shell 31 and is contacted with the inner tube 32, the opening at the end of the optical fiber 8 is directly contacted with the explosive 33.

The shell 37 which defines the second chamber 39 is positioned beneath the shell 31, and the secondary explosive 36 is charged into the second chamber 39 such that a vacant space 25 is formed in the upper portion of the second chamber 39. Further, in this embodiment, the side of the explosives 33 and 35 charged in the first chamber 38 and the side of the vacant space 25 formed in the second chamber 39 are surrounded with a restraining wall 34.

In this laser beam-detonatable blasting cap illustrated in FIG. 4, the bottom plate 12 of the shell 31 of the first chamber 38 is flown to the second chamber 39 by the gas pressure generated by the combustion of the explosive 35 in the first chamber 38 and is collided with the explosive 36 in the second chamber 39 to detonate the explosive 36. Other actions in this blasting cap are the same as those in the laser beam-detonatable blasting cap illustrated in FIG. 3. Accordingly, the detailed explanation referring to numerical values is omitted.

As the laser-oscillating apparatus for detonating the laser beam-detonatable blasting cap according to the present invention, there can be used solid lasers, such as a ruby laser, a YAG laser and the like, and gas lasers, such as a carbonic acid gas laser and the like. As the oscillating system for the laser, there can be used any of a continuous oscillation system and a pulse oscillation system. A laser beam having a wavelength of 0.6–11 μm and pulse duration of 0.1–10 ms is advantageously used.

The above described laser beam-detonatable blasting cap according to the present invention has the following merits.

(1) In the conventional laser beam-detonatable blasting cap, the explosive charged in the upper portion and being in contact with the optical fiber does not contain a laser beam-absorbing material. On the contrary, in the laser beam-detonable blasting cap according to the present invention, the explosive charged in the upper portion and being in contact with an optical fiber contains a laser beam-absorbing material. Therefore, in the blasting cap according to the present invention, the explosive charged in the upper portion is highly efficient in absorbing a laser beam, and can be surely ignited even by a laser beam having a small peak output power of a pulse duration of several μs generated by means of a pulse-oscillation system without using Q-switching or even by a laser beam generated by means of a continuous oscillation system, without the use of a laser beam having a large peak output power of a pulse duration of several tens ns generated by means of a laser-oscillation system using Q-switching.

(2) The explosive charged in the upper portion or the explosive charged in the first chamber contains a laser beam-absorbing material at the portion, at which the explosive absorbs a laser beam and is ignited. While, the explosive charged in the other portion does not contain a laser beam-absorbing material. Therefore, the latter explosive exhibits a large power in the combustion due to the absence of ingredients other than explosive.

(3) In the conventional laser beam-detonatable blasting cap, explosives are charged into the first and second chambers such that the loading density of an explosive charged in the upper portion is higher than that of an explosive charged in the lower portion in each chamber. On the contrary, in the laser beam-detonatable blasting cap according to the present invention, explosives are charged into the first and second chambers such that the loading density of an explosive charged in the lower portion is higher than that of an explosive charged in the upper portion in each chamber, and further that the loading density of the explosives charged into the second chamber is higher than that of explosives charged into the first chamber. Therefore, the explosive charged in the upper portion is easily deflagrated, is changed from deflagration to detonation, and can detonate surely the explosive charged in the lower portion.

(4) In the conventional laser beam-detonatable blasting cap, the sides of the first and second chambers are wholly covered with a restraining wall. On the contrary, in the laser beam-detonatable blasting cap according to the present invention, only the side of the explosive charged in the upper portion or in the upper and middle portions is covered with a restraining wall, and the side of an explosive charged in the lower portion is not covered with a restraining wall, and hence the explosive charged in the lower portion exhibits an initiation power to the side direction and can completely initiate an explosive, in which the laser beam-detonatable blasting cap according to the present invention has been set.

The following examples are given for the purpose of illustration of this invention and are not intended as limitations thereof.

EXAMPLE 1

A laser beam-detonatable blasting cap 1 illustrated in FIG. 1 was produced in the following manner.

Into a copper shell 2 having an outer diameter of 7.6 mm, a thickness of 0.3 mm and a length of 50 mm and having a bottom plate 3 of 0.3 mm thickness was charged a secondary explosive of PETN, used as an explosive 5 to be charged in the lower portion of the shell 2, in a loading density of 1.40 g/cm$^3$ in a region ranging from 0 mm to 10 mm from the bottom. An iron restraining wall 6 having an inner diameter of 5.0 mm, a thickness of 1 mm and a length of 30 mm was then arranged in the shell 2 such that the restraining wall 6 would be in contact with the explosive 5 charged in the lower portion of the shell 2. PETN containing 1% by weight of a laser beam-absorbing material of carbon black having an average particle size of 30 μm, used as an explosive 4 to be charged into the upper portion of the shell 2, was then charged into the inside of the restraining wall 6. A plug 7 was then put into the inside of the shell 2 such that the plug 7 was contacted with the restraining wall 6, and the plug 7 was adhered and fixed to the shell 2.

An optical quartz fiber 8 having a core diameter of 0.8 mm, a damping factor of 6 dB/km and a length of 30 m was connected to the resulting laser beam-detonatable blasting cap 1 illustrated in FIG. 1. When a laser beam having a wavelength of 1.06 μm, a pulse duration of 0.4 ms and an energy of 2.5 J was generated by means of a YAG laser and irradiated to the laser beam-detonatable blasting cap 1, the blasting cap 1 was completely detonated and penetrated through the lead plate (40 mm×40 mm×4 mm) used in the lead plate test defined in Japanese Industrial Standard (abbreviated as JIS) K4806-1978. Moreover, the blasting cap was able to initiate completely an explosive (TNT: trinitrotoluene 70%, talc 30%) used in the test for low explosives defined in JIS, and to give to a lead plate (70 mm×70 mm×30 mm) an explosion trace substantially the same as that obtained by the use of a No. 6 blasting cap.

EXAMPLE 2

A laser beam-detonatable blasting cap 10 illustrated in FIG. 2 was produced in the same manner as described in the production of the laser beam-detonatable blasting cap 1 in Example 1, except the following.

A copper shell 11 having an inner diameter of 6.2 mm, a thickness of 0.3 mm and a length of 55 mm and having a bottom plate 12 of 0.3 mm thickness was used. A secondary explosive of PETN was charged into the shell 11 in a loading density of 1.40 g/cm$^3$ in the lower region ranging from 0 mm to 15 mm from the bottom plate 12, and in a loading density of 1.15 g/cm$^3$ in the middle region ranging from 15 mm to 35 mm from the bottom plate 12, and a secondary explosive of tetryl containing 1% by weight of a laser beam-absorbing material of a black dyestuff (trademark: Direct Fast Black B, sold by Sumitomo Chemical Co.) was charged into the shell 11 in a loading density of 1.15 g/cm$^3$ in the upper region ranging from 35 mm to 45 mm from the bottom plate 12. A restraining wall 6 made of iron and having an inner diameter of 6.8 mm, a thickness of 1 mm and a length of 40 mm was then arranged around the shell 11 such that explosives 4 and 13 charged into the upper portion and middle portion, respectively, were surrounded with the restraining wall 6 and the explosive 5 charged into the lower portion was not covered with the restraining wall 6.

When the same tests as described in Example 1 were carried out, the same results as obtained in Example 1 was obtained.

COMPARATIVE EXAMPLE 1

Figure 5:
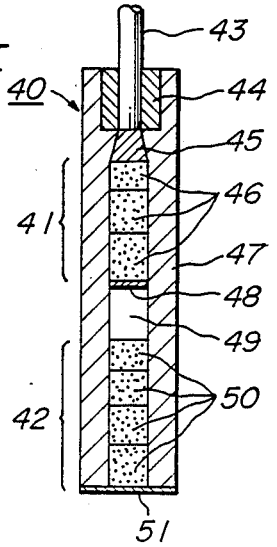
FIG 5 PRIOR ART
FIG. 5 is a cross-sectional view of a conventional laser beam-detonatable blasting cap.

A conventional laser beam-detonatable blasting cap 40 illustrated in FIG. 5 was produced in the following manner.

A glass lens 45 was put into a copper restraining wall 47 having a length of 58 mm, an inner diameter of 6 mm and a thickness of 1 mm. As an explosive 46 to be charged into a first chamber, a secondary explosive of PETN was used. That is, PETN was charged into the restraining wall 47 to form the first chamber 41 such that the PETN was charged in a loading density of 1.40 g/cm$^3$ in a region ranging from 0 mm to 4 mm from the lens surface, in a loading density of 1.20 g/cm$^3$ in a region ranging from 4 mm to 10 mm from the lens surface, and in a loading density of 1.10 g/cm$^3$ in a region ranging from 10 mm to 16 mm from the lens surface. A circular plate 48 made of copper and having a diameter of 6 mm and a thickness of 0.3 mm was arranged at the position corresponding to the bottom of the first chamber 41 and adhered and fixed to the restraining wall 47. PETN, used as an explosive 50 for the second chamber 42, was then charged into the restraining wall 47 so as to form a secondary chamber 42 separated from the first chamber 41 by a vacant space 49 having a length of 5 mm, such that the PETN was charged in a loading density of 1.40 g/cm$^3$ in a region ranging from 21 mm to 25 mm from the lens surface, in a loading density of 1.20 g/cm$^3$ in region ranging from 25 mm to 31 mm from the lens surface, in a loading density of 1.10 g/cm$^3$ in a region ranging from 31 mm to 37 mm from the lens surface, and in a loading density of 1.00 g/cm$^3$ in a region ranging from 37 mm to 43 mm from the lens surface. A copper plate having a diameter of 8 mm and a thickness of 0.3 mm was adhered and fixed to the bottom of the restraining wall 47 to form a bottom plate 51. A plug 44 was put into the restraining wall 47 and an optical fiber 43 was then penetrated through the plug 44 and fixed thereto.

When a laser beam was illustrated to this conventional laser beam-detonatable blasting cap 40 in the same manner as described in Example 1, this blasting cap 40 was neither ignited nor detonated.

COMPARATIVE EXAMPLE 2

The same conventional laser beam-detonatable blasting cap as described in Comparative Example 1 was produced, except that PETN containing 1% by weight of a laser beam-absorbing material of carbon black was charged in a loading density of 1.40 g/cm$^3$ in a region ranging from 0 mm to 4 mm from the surface of the lens 45, and the resulting blasting cap was subjected to the same tests as described in Example 1.

As the result, although thus conventional laser beam-detonatable blasting cap was ignited, this blasting cap was neither able to penetrate the lead plate of the lead plate test, nor able to initiate low explosives due to its poor power.

EXAMPLE 3

A laser beam-detonatable blasting cap 20 illustrated in FIG. 3 was produced in the following manner.

A secondary explosive of PETN was used as an explosive 27 for a second chamber 22, and charged into a copper shell 26 having an outer diameter of 7.6 mm, a thickness of 0.3 mm and a length of 15 mm and having a bottom plate 3 of 0.3 mm thickness in a loading density of 1.40 g/cm$^3$ in a region ranging from 0 mm to 10 mm from the bottom plate 3. A circular plate 24 having a diameter of 7.6 mm and a length of 0.3 mm was then adhered and fixed to a restraining wall 6 made of iron and having an inner diameter of 5.6 mm, a thickness of 1 mm and a length of 40 mm, and PETN containing 1% by weight of a laser beam-absorbing material of carbon black, used as an explosive 23 for a first chamber 21, was charged into the restraining wall 6 in a loading density of 1.15 g/cm$^3$ in a region ranging from 0 mm to 30 mm from the plate 24. The copper shell 26 of the second chamber 22 and the plate 24 of the first chamber 21 were adhered and fixed to each other by an adhesive such that the center axes of both the members were the same, and then a plug 7 was put into the restraining wall 6 and fixed thereto.

When the same tests as described in Example 1 were carried out by using the resulting laser beam-detonatable blasting cap illustrated in FIG. 3, the same good results as obtained in Example 1 were obtained.

EXAMPLE 4

A laser beam-detonatable blasting cap 30 illustrated in FIG. 4 was produced in the same manner as described in Example 3, except the following.

A shell 31 having an inner diameter of 6.2 mm and a thickness of 0.3 mm was used as a vessel for a first chamber 38, and an inner tube 32 having an inner diameter of 5.5 mm, a thickness of 0.35 mm and a length of 8 mm was arranged in the shell 31 at the portion contacting with an optical fiber 8. A shell 37 having an inner diameter of 6.2 mm and a thickness of 0.3 mm was used as a vessel for a second chamber 39. A secondary explosive of PETN, used as an explosive 35 for the first chamber 38, was charged into the first chamber 38 in a loading density of 1.15 g/cm$^3$ in a region ranging from 0 mm to 20 mm from the bottom plate 12, and a restraining wall 34 having a length of 35 mm was used in order to cover the first chamber 38 and the vacant space 25 formed in the second chamber 39.

When the same tests as described in Example 1 were carried out, the same good results as obtained in Example 1 were obtained.

What is claimed is:

1. A laser beam-detonatable blasting cap, comprising:

a shell member;

a secondary explosive consisting of pentaerythritol tetranitrate charged in an upper portion of said shell member at a loading density of 0.8–1.4 g/cm$^3$, said secondary explosive containing a laser beam-absorbing black material;

an explosive charged in a lower portion of said shell member at a loading density of 1–1.7 g/cm$^3$;

a restraining wall arranged around said secondary explosive charged in the upper portion of said shell member; and an optical fiber arranged in contact with said secondary explosive.

2. The blasting cap of claim 1, wherein said laser beam-absorbing black material comprises at least one material selected from the group consisting of carbon black, graphite and black dyestuff.

3. The blasting cap of claim 1, wherein the explosive charged in the lower portion of said shell member comprises at least one material selected from the group consisting of pentaerythritol tetranitrate, trinitrophenylmethylnitramine, trimethylenetrinitramine and cyclotetramethylenetetranitramine.

4. A laser beam-detonatable blasting cap, comprising:

a shell member;

a secondary explosive consisting of pentaerythritol tetranitrate charged in an upper portion of said shell member at a loading density of 0.8–1.4 g/cm$^3$, said secondary explosive containing a laser beam-absorbing black material;

a secondary explosive consisting of pentaerythritol tetranitrate charged in a lower portion of said shell member at a loading density of 1–1.7 g/cm$^3$;

a secondary explosive consisting of pentaerythritol tetranitrate charged in a middle portion of said shell member at a loading density which is greater than the loading density of the secondary explosive charged in said upper portion and less than the loading density of the secondary explosive charged in said lower portion;

a restraining wall arranged around the secondary explosives charged in said upper portion and said middle portion of said shell member; and an optical fiber arranged in contact with said secondary explosive charged in said upper portion of said shell member.

5. The blasting cap of claim 4, wherein the laser beam-absorbing black material comprises at least one material selected from the group consisting of carbon black, graphite and black dyestuff.

6. A laser beam-detonatable blasting cap, comprising:

a first chamber;

a secondary explosive consisting of pentaerythritol tetranitrate charged in said first chamber at a loading density of 0.8–1.4 g/cm$^3$, said secondary explosive containing a laser beam-absorbing black material;

a second chamber arranged separated from said first chamber by a vacant space;

a secondary explosive consisting of pentaerythritol tetranitrate charged in said second chamber at a loading density of 1–1.7 g/cm$^3$;

a restraining wall arranged around said first chamber; and an optical fiber arranged in contact with a top portion of said secondary explosive charged in said first chamber.

7. The blasting cap of claim 6, wherein said laser beam-absorbing black material comprises at least one material selected from the group consisting of carbon black, graphite and black dyestuff.

8. A laser beam-detonatable blasting cap, comprising:

a first chamber;

a secondary explosive consisting of pentaerythritol tetranitrite charged in an upper portion of said first chamber at a loading density of 0.8–1.4 g/cm$^3$, said secondary explosive containing a laser beam-absorbing black material;

a secondary explosive consisting of pentaerythritol tetranitrate charged in a lower portion of said first chamber;

a second chamber arranged separated from said first chamber by a vacant space;

a secondary explosive consisting of pentaerythritol tetranitrate charged in said second chamber at a loading density of 1–1.7 g/cm$^3$;

a restraining wall arranged around said first chamber; and an optical fiber arranged in contact with a top portion of said secondary explosive charged in the upper portion of said first chamber.

9. The blasting cap of claim 8, wherein said laser beam-absorbing black material comprises at least one material selected from the group consisting of carbon black, graphite and black dyestuff.

* * * * *